US008477966B2

(12) United States Patent
Prenta et al.

(10) Patent No.: US 8,477,966 B2
(45) **Date of Patent: *Jul. 2, 2013**

(54) IN-WALL SUB-WOOFER WITH HIGH-VOLUME DISPLACEMENT

(75) Inventors: Timothy Prenta, Simi Valley, CA (US); An Nguyen, West Hills, CA (US); Charles Sprinkle, Ventura, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 273 days.

This patent is subject to a terminal disclaimer.

(21) Appl. No.: 12/826,998

(22) Filed: Jun. 30, 2010

(65) Prior Publication Data

US 2010/0266149 A1 Oct. 21, 2010

Related U.S. Application Data

(63) Continuation of application No. 11/541,487, filed on Sep. 30, 2006, now Pat. No. 7,840,018.

(51) Int. Cl.
*H04R 25/00* (2006.01)

(52) U.S. Cl.
USPC ..... 381/152; 381/181; 381/351

(58) Field of Classification Search
USPC ..... 381/152, 345, 361–352, 163, 182, 381/386, 388, 395
See application file for complete search history.

(56) References Cited

U.S. PATENT DOCUMENTS

| | | | | |
|---|---|---|---|---|
| 4,326,099 | A | 4/1982 | Maille | |
| 5,388,162 | A | 2/1995 | Sohn | |
| 5,526,456 | A * | 6/1996 | Heinz | 381/182 |
| 5,850,460 | A * | 12/1998 | Tanaka et al. | 381/182 |
| 5,995,634 | A | 11/1999 | Zwolski | |
| 7,840,018 | B2 * | 11/2010 | Prenta et al. | 381/152 |

* cited by examiner

*Primary Examiner* — Suhan Ni
(74) *Attorney, Agent, or Firm* — Brooks Kushman P.C.

(57) ABSTRACT

An in-wall speaker system having at least one pair of active transducers mounted in a wall section. The active transducers may be mounted in at least one enclosure. Each active transducer has a sound radiating surface. Each active transducer is also mounted substantially perpendicular to a surface of the wall section with the sound radiating surfaces substantially parallel to each other. The sound radiating surfaces may be facing each other or away from each other. The in-wall speaker system may also include one or more pairs of passive radiators to generate sound from sound pressure generated by the active transducers. The pairs of speakers in the wall section may be mounted vertically or horizontally within the wall, with a slot or a vent at the opening at the space between the speaker pairs.

9 Claims, 4 Drawing Sheets

IN-WALL SUB-WOOFER WITH HIGH-VOLUME DISPLACEMENT

CROSS-REFERENCE TO RELATED APPLICATIONS

This application is a divisional of and claims priority to U.S. application Ser. No. 11/541,487, filed on Sep. 30, 2006, titled IN-WALL SUB-WOOFER SYSTEM WITH HIGH-VOLUME DISPLACEMENT, which application is incorporated by reference in this application in its entirety.

FIELD OF THE INVENTION

This invention relates generally to audio speaker systems and more particularly to an in-wall speaker system.

BACKGROUND

Many speaker systems are being mounted inside walls to spare the space required inside a room, and to enhance the surround-sound experience. However, in-wall speaker systems may occupy a large area of the wall they are built into. The area occupied by in-wall speaker systems may be quite significant when subwoofer speakers are part of the configuration.

In addition to the wall surface area required by in-wall mounted speakers, the speakers may transmit strong mechanical forces against the wall in which they are mounted. This is especially the case with subwoofers. The low frequencies at which subwoofers operate are more likely to cause mechanical forces that may cause the walls to vibrate.

There are other limitations. Standard wall depths limit woofer cone displacements. This leads to a need for the transducer to have a large radiating area to generate the volume displacement that is needed to create high sound pressure levels (SPL) at low frequencies. Due to the standard wall bay width, the largest typical transducer that can be mounted is a 10"woofer. Multiple 10" woofers are typically required to obtain needed volume displacements. Each woofer added requires more and more wall area.

In view of the above, there is a need for in-wall subwoofer systems that do not occupy too much wall area, do not cause too much wall vibration during operation and do not suffer the design constraints imposed by the geometry of the wall structures.

SUMMARY

In view of the above, systems consistent with the present invention include at least one pair of active transducers mounted in a wall section, each active transducer having a sound radiating surface and each active transducer mounted substantially perpendicular to a surface of the wall section with the sound radiating surfaces substantially parallel to each other.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In the following description of preferred embodiments, reference is made to the accompanying drawings that form a part hereof, and which show, by way of illustration, specific embodiments in which the invention may be practiced. Other embodiments may be utilized and structural changes may be made without departing from the scope of the present invention.

Figure 1:
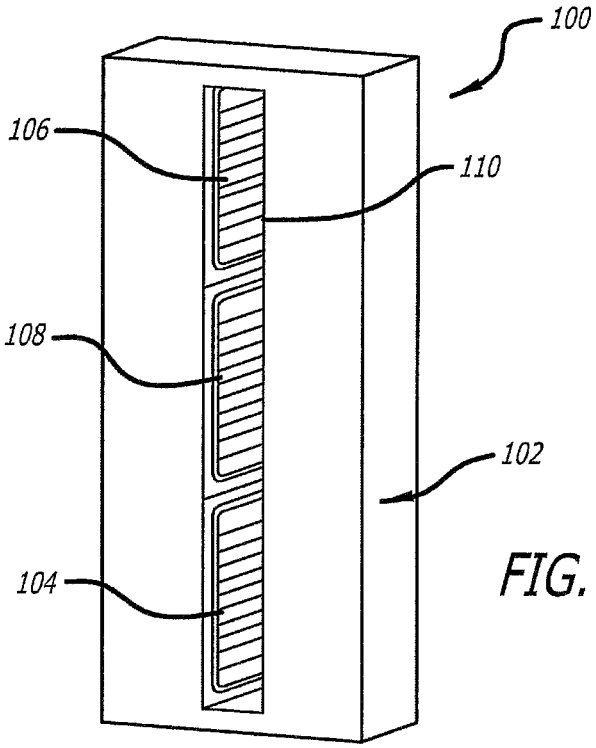
FIG. 1 is a perspective view of one example of an in-wall subwoofer system.

FIG. 1 is a perspective view of one example of an in-wall speaker system 100. The system 100 comprises an in-wall speaker enclosure 102 that may be installed as a unit inside a wall section. The in-wall speaker system 100 includes a first pair of sound generators 104, a second pair of sound generators 106 and a third pair of sound generators 108. The sound generators 104, 106, 108 may be speakers having a diaphragm surface that generates sound by its vibration. The pairs of sound generators 104, 106, 108 are mounted inside the in-wall speaker enclosure 102 so they face each other and the diaphragm surfaces of each transducer are positioned perpendicular to the surface of the wall to project sound pressure at each other. On one surface of the in-wall speaker enclosure 102, an opening 110 permits sound pressure radiation out of the space between the sound generator pairs. When installed in a wall, the wall surface at the opening 110 of the enclosure 102 may also be open or covered with a vented covering, such as a fabric or mesh that may additionally provide a decorative exposure to the wall containing the enclosure 102. The wall surface opposite the opening 110 is closed along the entire length of the opening so that sound pressure radiates from the opening 110.

Each pair of sound generators 104, 106, 108 in the example shown in FIG. 1 is either an active transducer pair or passive radiator pair. The active transducers in the example shown in FIG. 1 may be, without limitation, subwoofer speakers. The passive radiators may be subwoofer speakers without an active element. That is, the passive radiators include a diaphragm surface to radiate sound with its vibration, but lack an excitation coil connected to an audio signal source found in typical active transducers. Passive radiators are excited by sound pressure radiation initially generated by the active transducers in the in-wall speaker system 100.

At least one pair of sound generators in the example shown in FIG. 1 is an active transducer pair. However, all three sound generator pairs may be active transducers. In one example, the sound generator pairs 104, 106, 108 in FIG. 1 may be arranged so that the third pair of sound generators 108 is an active transducer pair and the other two pairs 104, 106 are passive radiator pairs.

The sound generators in the in-wall speaker system 100 in FIG. 1 may be any suitable shape and size that permits mounting inside the wall section 102 such that the sound generator pairs face each other. In the example shown in FIG. 1, the sound generators are rectangular shaped. A rectangular shape in the configuration maximizes the sound pressure radiated by maximizing the area available for the sound generators. However, the sound generators may be any shape.

The in-wall speaker enclosure 102 in the example shown in FIG. 1 is a box-like container that holds the sound generators in their configuration as described above. The enclosure 102 may be made of wood, metal, plastic, fiberglass, or any other suitable rigid material. The material selected would depend on the desired specifications for the enclosure 102. Wood may be better at suppressing vibrations than metal, but metal may make more efficient use of space. The in-wall speaker enclosure 102 may be designed with specifications that allow for easy installation into a wall space. Most walls are constructed with drywall on studs with a standard space between drywall panels and a standard distance between adjacent studs. The in-wall speaker enclosure 102 may be designed to be thin enough to easily fit inside the space between drywall panels and wide enough to be easily mounted to adjacent studs. If a wider enclosure 102 is desired, the enclosure 102 may be designed to be wide enough to be mounted to one stud on one side. The next stud may be replaced by a frame for holding the enclosure 102; and the other side of the enclosure 102 may be affixed to the next stud.

The configuration of the example in FIG. 1 advantageously allows for high volume displacement in a thin enclosure that may fit inside a wall. The sound generators face each other allowing for opposing forces to cancel each other. Dry wall panels are not mechanically excited and wall/stud vibration is minimized. The in-wall speaker enclosure 102 also advantageously permits installation of the entire speaker configuration into a wall by easily inserting the entire enclosure into the wall space and finishing the drywall over and/or around the enclosure.

It is noted that FIG. 1 does not show electrical connections to the active transducers 108. Signal amplifiers and/or processors may be included in the in-wall speaker system 100, or outlets may be included to receive externally sourced electrical signals. Those of ordinary skill in the art will appreciate that the active transducers 108 operate by receiving electrical signals over electrical connections, but that the electrical connections may be implemented in any manner without affecting the scope of the invention.

Figure 2:
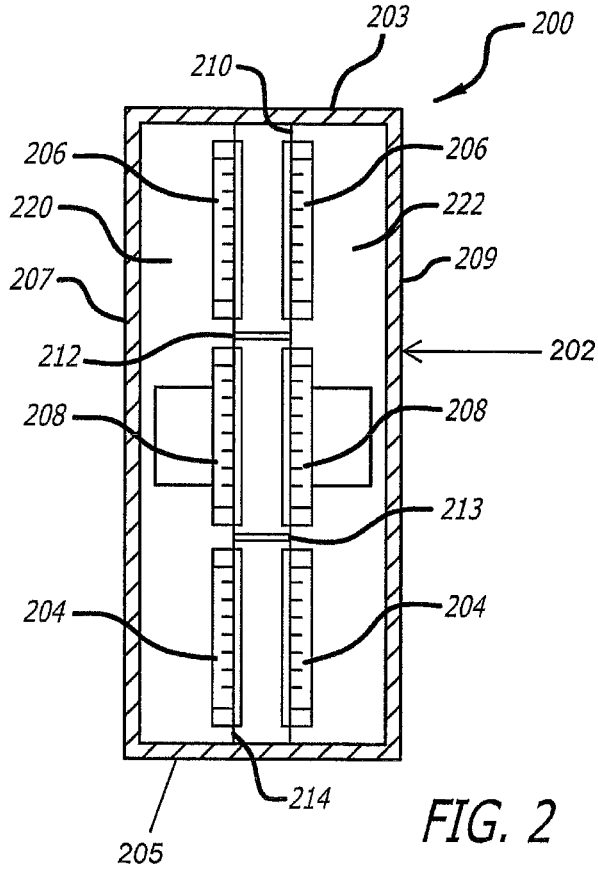
FIG. 2 is a cross-sectional view of an example of an in-wall subwoofer system.

FIG. 2 is a cross-sectional view of an example of the in-wall speaker system of FIG. 1. The in-wall speaker system 200 in FIG. 2 includes an upper pair of passive transducers 206 and a lower pair of passive radiators 204. A pair of active transducers 208 is mounted between the upper and lower pairs of passive radiators 204, 206. The active and passive transducers 204, 206, 208 are contained in an in-wall speaker enclosure 202, which has an upper member 203, a lower member 205, a left side member 207 and a right side member 209. The upper pair of passive radiators 206 may be mounted by a bracket 210 fastened to the upper member 203 of the in-wall speaker enclosure 202. The upper pair of passive radiators 206 may be fastened to the active transducer pair 208 with a second mounting bracket 212. A third mounting bracket 213 attaches the active transducer pair 208 to the lower passive radiator pair 204. And the bottom pair of passive radiators 204 may be fastened to the lower member 207 of the in-wall speaker enclosure 202 by a fourth mounting bracket 214. Those of ordinary skill in the art will appreciate that any suitable form of mounting the transducers within the in-wall speaker enclosure 202 may be used in examples of the in-wall speaker system.

In the example shown in FIG. 2, the in-wall speaker enclosure 202 may be further covered on sides parallel to the wall surface in which it would sit with openings on one side to radiate sound pressure as described below. The other side, which is opposite the side radiating sound pressure, may be covered to provide a backstop for the sound pressure. The transducer pairs may also have first and second air spaces 220, 222. The first and second air spaces 220, 222 advantageously, contain airflow within the system 200 to allow for more efficient excitation of the passive radiators 204, 206 by the active transducers 208.

Figure 3:
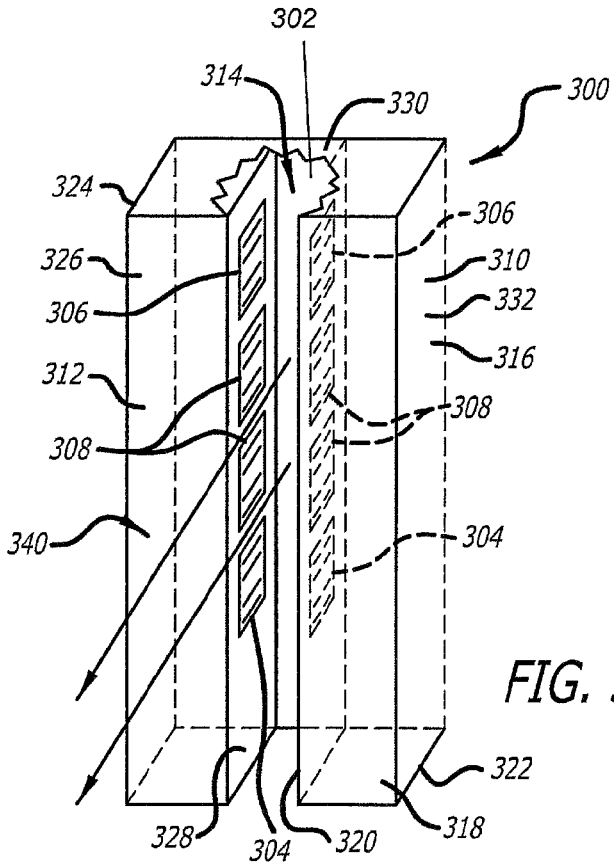
FIG. 3 is a semi-transparent, perspective view of another example of an in-wall system.

FIG. 3 is a transparent, perspective view of another example of an in-wall speaker system 300. The in-wall speaker system 300 in FIG. 3 includes two enclosures, a right enclosure 310 and a left enclosure 312. The right enclosure 310 includes a right side panel 316, a right front panel 318, and a right inside panel 320. The left enclosure 312 includes a left side panel 324, a left front panel 326, and a left inside panel 328. Both the right enclosure 310 and the left enclosure 312 are closed off at the top and bottom by a top panel 330, which extends across the tops of both enclosures 310, 312, and by a bottom panel 322, which extends across the bottoms of both enclosures, respectively. The right and left enclosures 310, 312 are closed off in the back by a back panel 332, which extends across the back of both enclosures 310, 312.

The in-wall speaker system 300 in FIG. 3 also includes a pair of upper passive radiators 306, two pairs of active transducers 308 and a pair of lower passive radiators 304. The pairs of active transducers 308 and passive radiators 304, 306 are mounted on the left and right inside panels 320, 328 of the right and left enclosures 310, 312. The left and right inside panels 320, 328 are parallel to each and hold the pairs of transducers 304, 306, 308 so that each pair faces each other opposite a space within a slot 314 between the first enclosure 310 and the second enclosure 312. The rear portion of the wall section 302 opposite the slot opening 314 is sealed in the wall section 302 shown in FIG. 3.

The right and left enclosures 310, 312 in FIG. 3 are configured to allow the active transducers 308 to generate sound pressure within the right and left enclosures 310, 312 that excite the passive radiators 304, 306. The active transducers 308 and passive radiators 304, 306 also generate sound pressure that is radiated out of the slot 314 in the wall section 302 as depicted by the arrows at 340.

One of ordinary skill in the art will appreciate that the number of transducers and passive radiators used may vary. The example of FIG. 3 shows four pairs of transducers and passive radiators. At least one pair of transducers in the example of FIG. 3 may be a pair of active transducers, but as many as all of the pairs of transducers may be active transducers. The transducers in any example described herein may be typical loudspeaker transducers, tactile transducers or any other sound generating device.

In addition, the right and left enclosures 310, 312 may be configured dimensionally to fit inside a wall section according to standard construction dimensions. The right and left enclosures 310, 312 may also be configured as separate units and according to a more customized installation.

The right and left enclosures 310, 312 may be made of wood, metal, plastic, fiberglass, or any other suitable rigid material. The material selected would depend on the desired specifications for the enclosures 310, 312. Wood may be better at suppressing vibrations than metal, but metal may make more efficient use of space.

Figure 4:
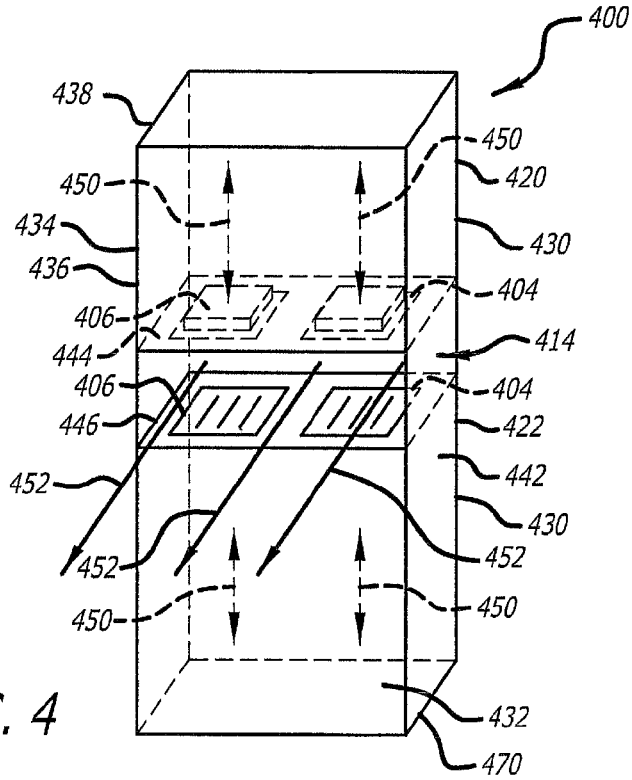
FIG. 4 is a transparent, perspective view of another example of an in-wall system.

FIG. 4 is a transparent, perspective view of another example of an in-wall speaker system 400. The in-wall speaker system 400 in FIG. 4 includes two enclosures, a top enclosure 420 and a bottom enclosure 422. The top and bottom enclosures 420, 422 are positioned to form a horizontal slot 414 between the top and bottom enclosures 420, 422. The top enclosure 420 is formed by a top front panel 434, a topmost panel 438, and a top inside panel 444. The bottom enclosure 422 is formed by a bottom front panel 432, a bottom-most panel 440, and a bottom inside panel 446. The top and bottom enclosures 420, 422 share a right side panel 442, a left side panel 436, and a back panel 430. The top and bottom enclosures 420, 422 are configured so that the top inside panel 444 and the bottom inside panel 446 have the slot 414 between them.

The in-wall system 400 in FIG. 4 also includes one pair of active transducers 404 and one pair of passive radiators 406 configured so that the transducers in each pair face away from each other on opposite sides of the slot 414. One of the pair of the active transducers 404 and one of the pair of the passive radiators 406 are mounted on the top inside panel 444 of the top enclosure 420. The other one of the pair of the active transducers 404 and the other one of the pair of the passive radiators 406 are mounted on the bottom inside panel 446 of the bottom enclosure 422. The slot 414 in the wall section 402 in the example of FIG. 4 is configured horizontally as opposed to vertically as shown in FIGS. 1-3. The example in FIG. 4 shows a pair of active transducers 404 and a pair of passive radiators 406; however, any number of pairs of transducers and/or passive radiators may be used. The system 400 may include at least one pair of active transducers. Multiple pairs of transducers may be made up of any combination of active transducers and passive radiators; but passive radiators are optional.

The in-wall system 400 in FIG. 4 advantageously provides space inside the top and bottom enclosures 420, 422 for the sound pressure generated by the active transducers 404 to excite the passive transducers 406 as shown by arrows 450. The horizontal slot 414 provides for sound pressure radiation of the sound into a room as shown by arrows 452. The top and bottom enclosures 420, 422 in FIG. 4 may be configured dimensionally to fit within a wall space having standard construction dimensions. In addition, the top and bottom enclosures 420, 422 may be configured as separate units that may each fit within a wall space having construction dimensions, but with the ability to vary the dimensions of the slot 414 between the enclosures.

The top and bottom enclosures 410, 412 may be made of wood, metal, plastic, fiberglass, or any other suitable rigid material. The material selected would depend on the desired specifications for the enclosures 410, 412. Wood may be better at suppressing vibrations than metal, but metal may make more efficient use of space.

Figure 5:
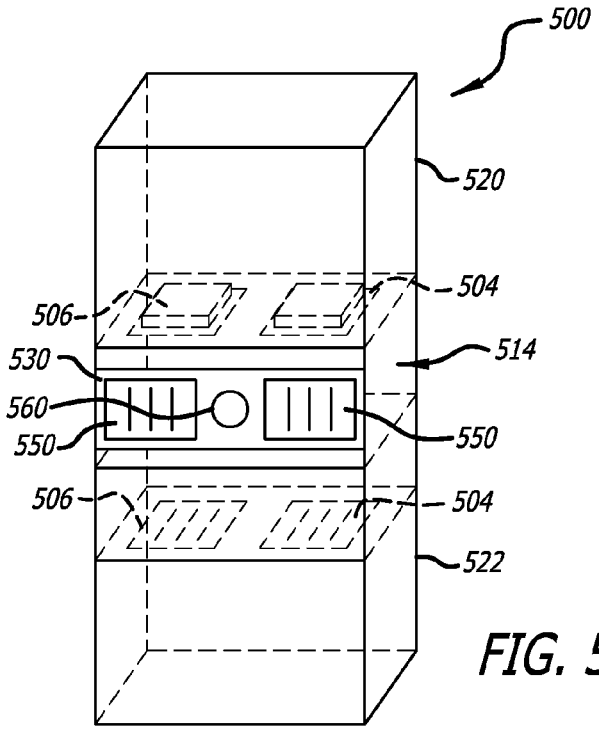
FIG. 5 is a semi-transparent, perspective view of another example of an in-wall system.

FIG. 5 is a semi-transparent, perspective view of another example of an in-wall speaker system 500. The in-wall speaker system 500 in FIG. 5 depicts a full range speaker system. The in-wall speaker system 500 in FIG. 5 includes a top and bottom enclosure 520 similar to the enclosures described above with reference to FIG. 4. The top and bottom enclosures 520, 522 are separated to form a slot 514 for radiation of the sound pressure from two pairs of subwoofers 504, 506. The in-wall system 500 in FIG. 5 also includes a slot panel 530 that only partially covers the slot 514. The slot panel 530 includes a pair of midrange speakers 550 and a tweeter 560 mounted vertically on the slot panel 530 to radiate sound out into a room. The example of the in-wall speaker system 500 in FIG. 5 depicts operation of a full-range speaker system that takes advantage of opposing forces of active and/or passive subwoofers in opposite directions configured so as to minimize wall vibration.

Figure 6:
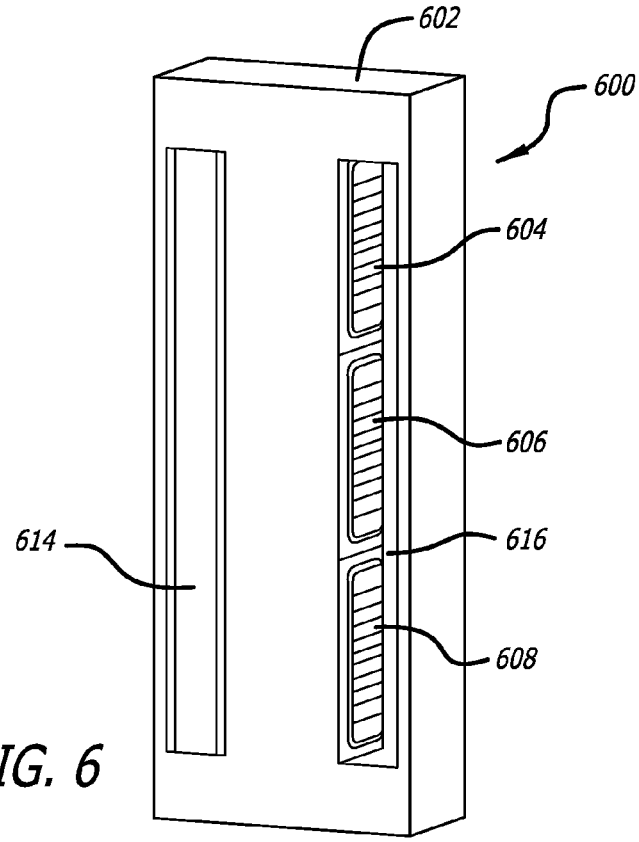
FIG. 6 is a perspective view of another example of an in-wall subwoofer system.

FIG. 6 is a perspective view of another example of an in-wall speaker system 600. The in-wall speaker system 600 includes a single enclosure 602 similar to the in-wall speaker enclosure 102 in FIG. 1. However, the in-wall speaker enclosure 602 in FIG. 6 includes two slots, a left slot 614 and a right slot 616. The in-wall speaker enclosure 602 includes a first pair of transducers 604, a second pair of transducers 606, and a third pair of transducers 608, although only one of each pair of transducers is visible in the perspective view of FIG. 6. At least one of the pairs of transducers 604, 606, 608 is a pair of active transducers, but all three pairs may be active transducers. The transducer pairs 604, 606, 608 may be mounted so that the sound generating surfaces face each other and away from the slots 614, 616. Alternatively, the transducer pairs 604, 606, 608 may be mounted so that the sound generating surfaces face away from each other and into the slots 614, 616 to radiate sound pressure directly into the slots 614, 616. When the transducer pairs 604, 606, 608 are mounted to face away from each other, opposing forces are advantageously canceled out inside the enclosure 602.

Figure 7:
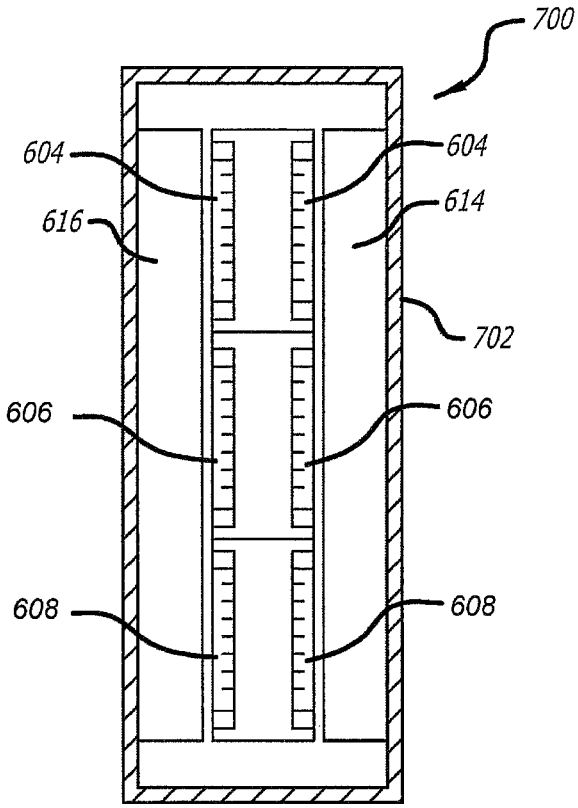
FIG. 7 is a cross-sectional view of the example in-wall subwoofer system of FIG. 6.

FIG. 7 shows a cross-sectional view of an in-wall speaker system 700 similar to the system 600 in FIG. 6. FIG. 7 shows the pairs of transducers 604, 606, 608 mounted vertically within an enclosure 702. The enclosure 702 includes a right slot 614 and a left slot 616 for radiating sound pressure into a listening room. As described above with reference to FIG. 6, the pairs of transducers 604, 606, 608 may face each other, or away from each other.

Figure 8:
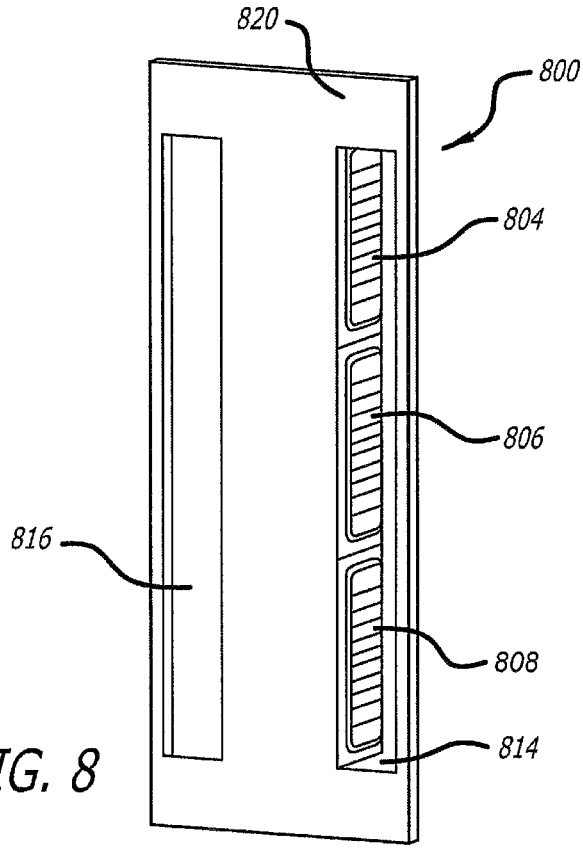
FIG. 8 is a perspective view of another example in-wall subwoofer system.

Examples of in-wall speaker systems above have been described as including either single or dual enclosures having slots that may be inserted into wall sections. In another example shown in FIG. 8, an in-wall speaker system 800 may not be in an enclosure and instead include pairs of transducers 804, 806, 808 mounted inside the wall space. The transducer pairs 804, 806, 808 may be mounted using any suitable bracketing systems to top and bottom studs in the wall space such that the pairs of transducers 804, 806, 808 face each other or away from each other as described above with reference to FIGS. 6 and 7. The configuration of transducers may then be covered with a panel 820 having slots 814 and 816. The transducer pairs 804, 806, 808 may also be mounted to the panel 820 and installed as a unit to an open wall space. Performance of the in-wall speaker system 800 is optimized by installing in a space that seals the side opposite the slots 814 and 816 to provide a backstop for the airflow generated by the transducers 804, 806, 808. The example in FIG. 8 shows two slots 814 and 816. However, in other examples, the panel 820 may have one slot between the pairs of transducers 804, 806, 808 similar to the example of the in-wall speaker enclosure 102 shown in FIG. 1.

The foregoing description of an implementation has been presented for purposes of illustration and description. It is not exhaustive and does not limit the claimed inventions to the precise form disclosed. Modifications and variations are possible in light of the above description or may be acquired from practicing the invention. Note also that the implementation may vary between systems. The claims and their equivalents define the scope of the invention.

The invention claimed is:

1. A speaker system comprising:

at least one pair of active transducers for being mounted inside a section of a wall, each transducer having a sound radiating surface and each active transducer for being mounted substantially perpendicular to a surface of the section of the wall with the sound radiating surfaces for being substantially in parallel to each other and for facing in different directions.

2. The system of claim 1 further comprising:

at least one pair of passive radiators each having a passive sound radiating surface the at least one pair of passive radiators being mounted substantially perpendicular to the surface of the section of the wall with the passive sound radiating surfaces substantially in parallel to each other.

3. The system of claim 1 where the at least one pair of active transducers are arranged to be mounted with corresponding sound radiating surfaces facing each other.

4. The system of claim 1 where the at least one pair of active transducers are arranged to be mounted with corresponding sound radiating surfaces facing away from each other.

5. The system of claim 1 further comprising at least one slot to provide an opening for sound pressure radiation.

6. The system of claim 1 where the at least one pair of active transducers are speakers of a type selected from a group consisting of a subwoofer, a woofer, a mid-range speaker, and a tweeter.

7. The system of claim 1 where the at least one pair of active transducers includes a pair of subwoofers, the system further comprising:

at least one or more transducers of any audio frequency range mounted substantially parallel to the surface of the section of the wall in a space between the at least one pair of subwoofers.

8. The system of claim 1 where the at least one pair of active transducers have sound pressure radiating surfaces facing each other.

9. The system of claim 1 where the at least one active transducers have sound pressure radiating surface facing away from each other.

* * * * *